United States Patent [19]

Man

[11] Patent Number: 4,757,485

[45] Date of Patent: Jul. 12, 1988

[54] COMPOSITE WRIST WATCH

[75] Inventor: Tam P. Man, Hong Kong, Hong Kong

[73] Assignee: Perfect Products Co., Ltd., Hong Kong

[21] Appl. No.: 24,539

[22] Filed: Mar. 11, 1987

[51] Int. Cl.[4] ..... G04B 37/00

[52] U.S. Cl. ..... 368/281; 368/282

[58] Field of Search ..... 368/276–285, 368/294–296

[56] References Cited

U.S. PATENT DOCUMENTS 3,585,794 6/1971 Klingenberg ..... 368/281

FOREIGN PATENT DOCUMENTS 204917 7/1939 Switzerland ..... 368/281

*Primary Examiner*—Bernard Roskoski

[57] ABSTRACT

A composite wrist watch comprises a case body, a case body mounting structure for accommodating the case body therein and a strap removably coupled to the case body mounting structure. The case body mounting structure comprises a plurality of segments each being disposed radially from the outer circumferential portion of the case body and having means provided thereon for releasable engagement with adjacent segments. The segments are arranged in radial alignment with at least a part of the surfaces defining a portion of the exterior configuration of the wrist watch. The strap consists of a plurality of links each having coupling means provided thereon adapted to removably couple to one another or to a strap receiving segment of said case body mounting structure by means of snap-fit action.

8 Claims, 14 Drawing Sheets

COMPOSITE WRIST WATCH

BACKGROUND OF THE INVENTION

This invention relates in general to wrist watch and in particular to wrist watch case body and strap that are composed of parts adapted to be removably inteconnected to one another wherein each part is adapted to be interchangeable and replaceable, if desired.

Wrist watches are widely known and used. In recent years, there has been an increasing demand for a wrist watch with a better design and outlook. To this end, designers in this field have been and are still trying to come up with wrist watch that meets this demand. One attempt is to produce a watch with colorful dial surface. Another attempt is to produce a watch case body with outstanding configuration and attractive appearence. In this respect, there are watch cases manufactured in a wide variety of shape, such as oval, rectangle, triangle and even sectorial.

However, the conventional wrist watches share a common defect in design in that the exterior configuration thereof is basically fixed and change in appearence of the wrist watch is made possible only by changing the strap which is removably attached to the case body of the watch.

SUMMARY OF THE INVENTION

The object of the invention is to provide a wrist watch case body and strap wherein the case body are strap are composed of parts which are removably interconnectable to one another and adapted to be replaceable or interchangeable. The parts should also be light in weight and relatively quick and easy to assemble and disassemble.

According to the present invention, there is provided a composite wrist watch including a case body, a case body mounting structure for securing said case body therein and a strap removably mounted to said case body mounting structure, said case body mounting structure comprising a plurality of segments each being disposed radially from an outer circumferential portion of said case body and having means provided thereon for releasable engagement with adjacent segments, said segments being arranged in radial alignment with at least a part of the surfaces defining a portion of the exterior configuration of said wrist watch, wherein said segments are adapted to be mountable and dismountable in the radial direction with respect to said case body, said strap comprising a plurality of links each having coupling means provided thereon adapted to removably couple to one another or to a strap receiving segment of said case body mounting structure.

BRIEF DESCRIPTION OF THE DRAWINGS

A specific embodiment of the invention will now be described by way of example with reference to the accompanying drawings wherein.

The present invention utilizes certain concepts as are set forth in the claims appended to this specification. Those skilled in the arts will understand that these concepts are capable of being utilized in a variety of embodiments which may differ from the present embodiment utilized for illustrative purposes herein. Hence, this invention is not to be construed as being limited solely to the illustrative embodiment, but should only be construed in view of the claims.

DETAILED DESCRIPTION OF THE PREFERRED EMBODIMENT

Figure 1:
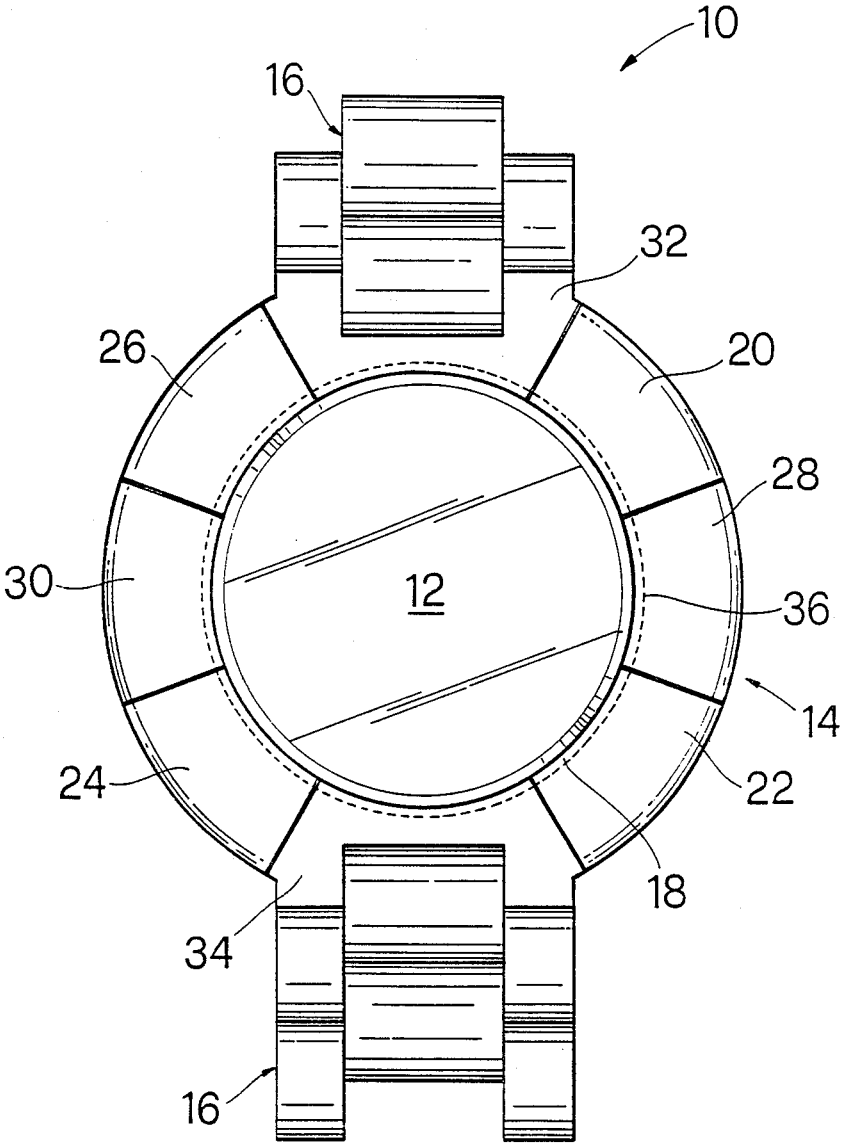
FIG. 1 is a plan view of a preferred composite wrist watch according to the present invention showing a case body, a case body mounting structure and a portion of a strap.

Referring now in more detail to the drawings, in which like reference numerals represent like parts throughout the several views, FIG. 1 shows a partial plan view of a composite wrist watch designated generally by reference numeral 10. The composite wrist watch 10 comprises a main case body 12, a case body mounting structure 14 and strap 16. The case body mounting structure 14 consists of, according to the preferred embodiment, eight segments 20, 22, 24, 26, 28, 30, 32 and 34, each being disposed radially from the outer circumferential portion 36 of the main case body 12. The eight segments 20, 22, 24, 26, 28, 30, 32 and 34 are interconnected to one another and are arranged in annular alignment to form a generally ring-shaped structure adapted to accommodate the main case body 12 therein. The interconnecting mechanism of the segments of the case body mounting structure 14 will be described later. The ends of the strap 16 are removably attached to respective strap receiving segments 32 and 34.

Figure 2:
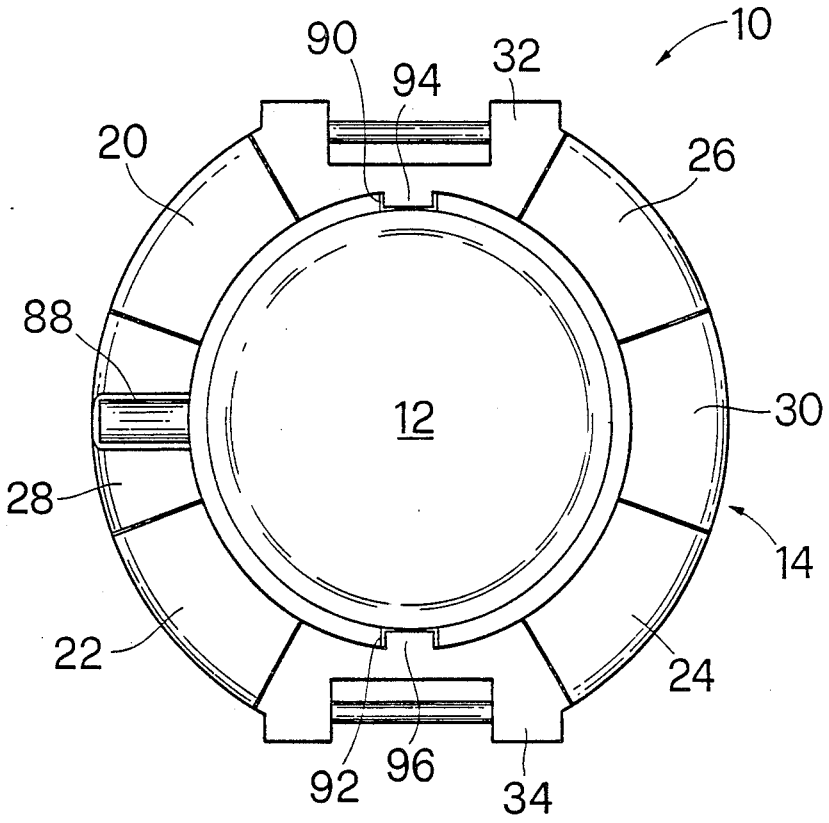
FIG. 2 is an underneath plan view of the preferred wrist watch of FIG. 1 with the strap being removed.

FIG. 2 shows an underneath plan view of the composite wrist watch 10 in FIG. 1 with the strap 16 removed to show the respective strap mounting portion of segments 32 and 34. Detail structure of the segments of the case body mounting structure 14 will now be described.

Figure 3:
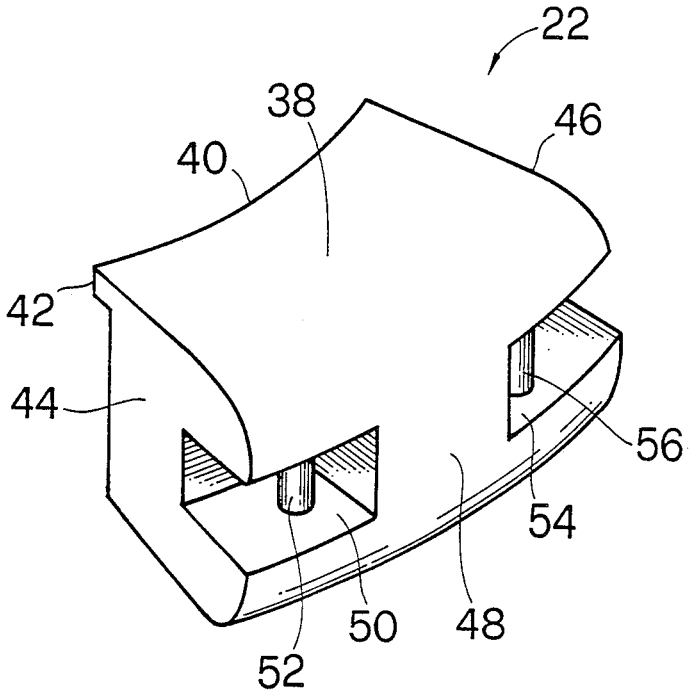
FIG. 3 is an enlarged perspective view of a segment of the case body mounting structure showing the female structures thereof.

FIG. 3 is an enlarged perspective view of segment 22. It can be seen that the segment 22 has a general shape of a ring segment and is formed of a one piece moulded plastic body 38. The body 38 has a vertically extending arcuate wall 40 which defines a surface against which part of the outer circumferential portion 36 of the main case body 12 is abutted. Provided integrally on the upper portion of the arcuate wall 40 is a radially inwardly directed projection 42.

Two end walls 44 and 46 are spaced apart by the arcuate wall 40 and a front end wall 48 and are disposed at an angle to each other. The front end wall 48 defines a portion of the exterior configuration of the wrist watch 10. Disposed at the outer peripheral portion of the segment 22 intermediate the end wall 44 and the front end wall 48 is a first recess 50 which extends radially inwardly from the front end wall 48 to a portion intermediate the front end wall 48 and the arcuate wall 40. Reference numeral 52 denotes a vertically extending cylindrical pin which is integrally provided within and disposed substantially at the center of the recess 50.

A second radially extending recess 54 is provided at the outer peripheral portion intermediate the end wall 46 and the front end wall 48 and has a vertically extending cylindrical pin 56 provided integrally therein substantially at the center thereof.

Recesses 50 and 54 are disposed at a distance from each other and are arranged in radial alignment. Each of the recesses 50 and 54 defines a female structure for receiving a corresponding male structure therein.

The segments designated by reference numerals 20, 24 and 26 are identical in structure to the segment 22 hereinbefore described. Referring back to FIG. 1 or FIG. 2, the four segments 20, 22, 24 and 26 are, according to the illustrating embodiment, disposed generally at an interval of 90° around the outer circumferential portion 36 of the main case body 12.

Figure 4:
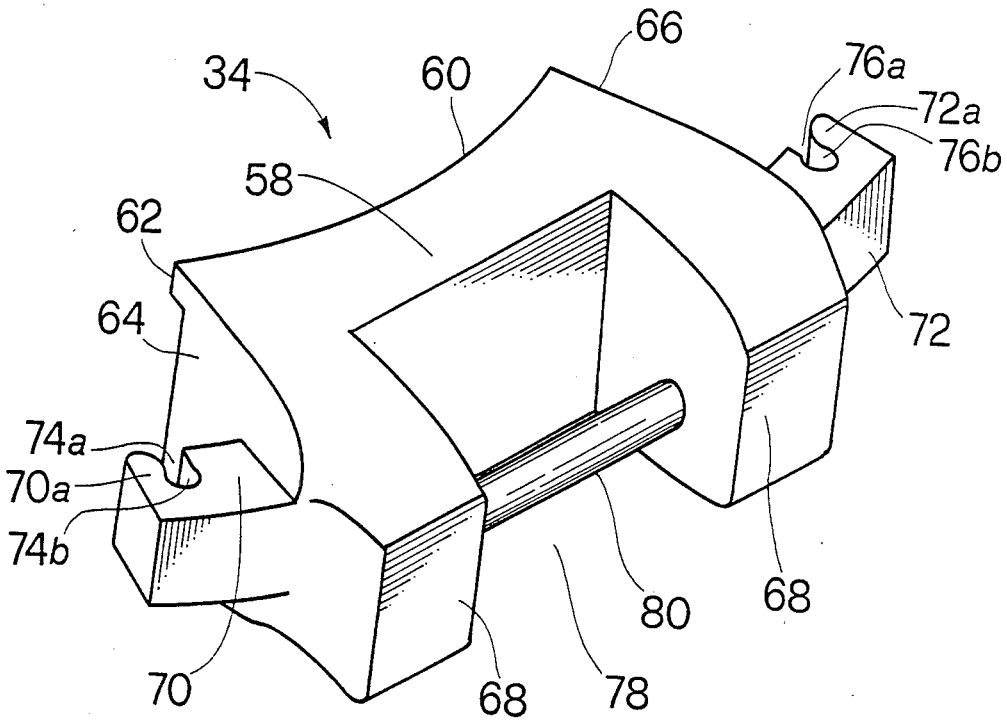
FIG. 4 is an enlarged perspective view of another segment of the case body mounting structure showing the male structures thereof.

FIG. 4 is an enlarged perspective view of segment 34. The segment 34 is formed of a one piece moulded plastic body 58 having a vertically extending arcuate wall 60. The arcuate wall 60 defines a surface against which part of the outer circumferential portion 36 of the main case body 12 is abutted. A radially inwardly directed projection 62 is provided on the upper portion of the arcuate wall 60 and forming an integral part thereof.

Two end walls 64 and 66 are spaced apart by the arcuate wall 60 and a front end wall 68 and are disposed at an angle to each other.

Projecting outwardly from end wall 64 is a first projection 70 defining a male structure adapted to be received in a corresponding female structure of an adjacent segment, in this example, segment 24. Projection 70 has an inturned resilient arm portion **70*a* which defines an inwardly facing and vertically extending groove 74 for receiving and frictionally gripping a corresponding cylindrical pin of segment 24. The groove 74 is composed of an access slot 74*a* and a vertically extending socket or bore 74*b*** which is part cylindrical in shape.

A second projection, designated by reference numeral 72, projects outwardly from end wall 66 and defining a male structure receivable in a corresponding female structure of adjacent segment 22. Projection 72 has an inturned resilient arm portion **72*a* which defines an inwardly facing and vertically extending groove 76 for receiving and frictionally gripping, in this example, corresponding pin 52 of adjacent segment 22. Groove 76 is composed of an access slot 76*a* and a vertically extending bore 76*b*** which is part cylindrical in shape.

A cutout portion 78 is provided on the front end portion of segment 34 for receiving an end of strap 16 therein. The cutout portion 78, having a rectangular plan view, is provided integrally with an elongated bar member 80 which extends transversely relative to the longitudinal direction of the strap 16.

Segment 32 has an identical structure with segment 34 and is disposed oppositely thereto around the outer circumferential portion 36 of the main case body 12.

Figure 5:
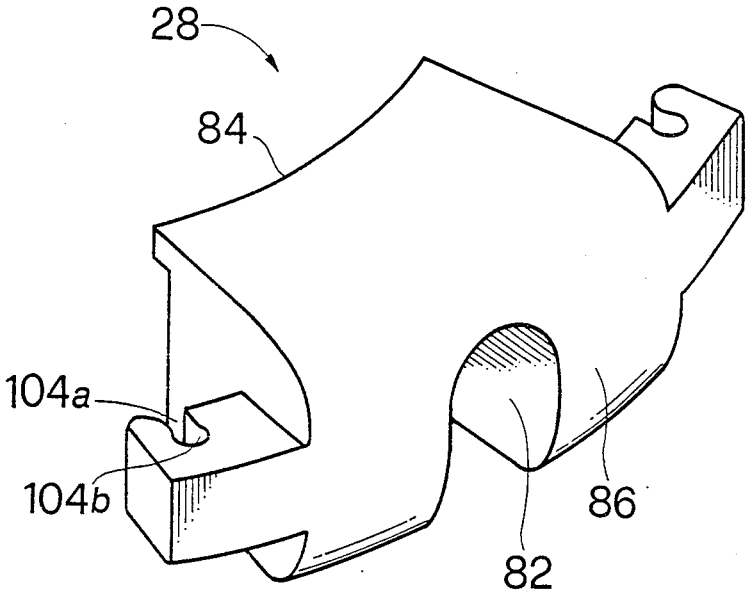
FIG. 5 is an enlarged perspective view of yet another segment of the case body mounting structure showing the male structures and the cutout portion for receiving a winding stem sheath therein.

FIG. 5 shows an enlarged perspective view of segment 28, the structure of which is similar to that of segment 34 except that the cutout portion 78 is replaced by a downwardly facing aperture 82. This aperture 82 extends from an arcuate wall 84 to a front end wall 86 of the segment 28 and is adapted to receive a winding stem sheath passing therethrough.

Segment 30 is identical in structure with segment 28 except that segment 30 is not, in this example, provided with any aperture thereon.

It can be seen that the strap receiving segments 32 and 34 have dimensions larger than that of segments 20, 22, 24, 26, 28 and 30.

Figure 6:
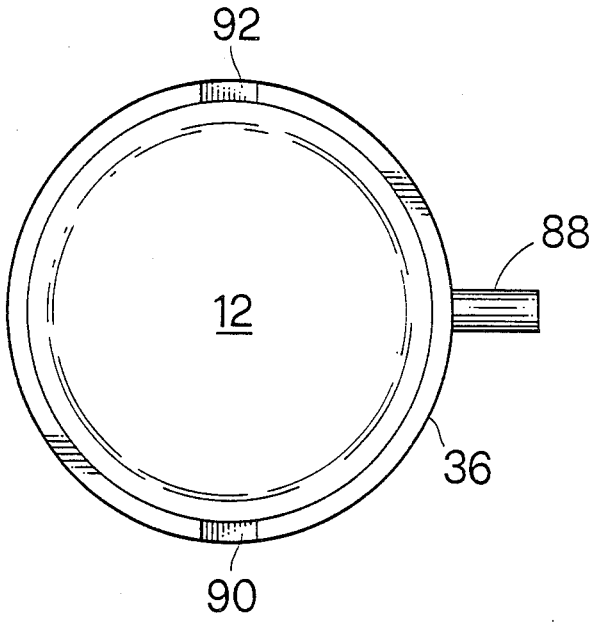
FIG. 6 is an underneath plan view of the case body.

FIG. 6 is an underneath plan view of the main case body 12. Extending radially from and integrally with the main case body 12 is a tubular body 88 which serves as a sheath for accommodating and protecting a winding stem (not shown) therein.

Reference numerals 90 and 92 denotes recess means which are provided at the lower peripheral portion of the main case body 12 and are disposed oppositely along the peripheral portion thereof. Recess means 90 and 92 are adapted to receive respective stop means 94 and 96 (FIG. 2) which are provided, according to the preferred embodiment, on strap receiving segments 32 and 34 respectively. Recess means 90, 92 and stop means 94, 96 are used to facilitate the registration of the main case body 12 to the case body mounting structure 14.

Further illustration of the incorporation of the main case body 12 and the case body mounting structure 14 will now be described with reference to FIGS. 7 and 8.

Figure 7:
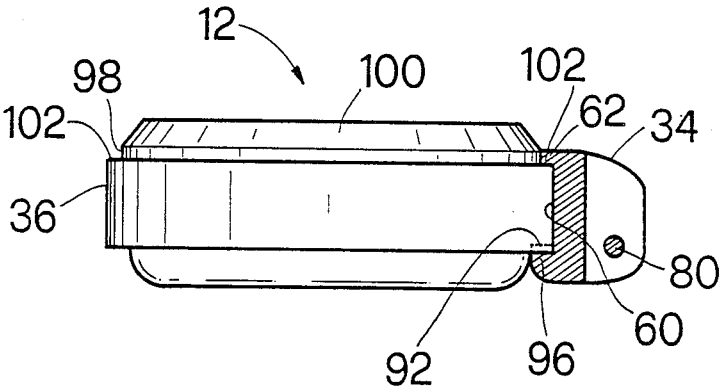
FIG. 7 is a side view of the case body incorporating with the segment shown in FIG. 4.

FIG. 7 shows a side view of the main case body 12 incorporating with segment 34 with a portion of the segment 34 being cut away showing a sectional thereof. The peripheral skirt portion 98 of watch crystal 100 and the outer circumferential portion 36 of the main case body 12 define an annular stepped recess 102 for receiving the radially inwardly directed annular projection 18 (FIG. 1) therein. As illustrated in FIG. 7, projection 62 of segment 34 is received in the stepped recess 102 so that arcuate wall 60 is abutted against the outer circumferential surface 36 of the main case body 12 whereby preventing axial movement of the main case body 12 in a first axial direction.

Stop means 96 of segment 34 fits into the recessed portion 92 of the main case body 12 whereby axial movement of the main case body 12 in the second axial direction is prevented.

Other segments are mounted to the main case body 12 in a similar manner as segment 34 illustrated in FIG. 7 such that segments with female structures are alternately coupled with segments with male structure whereby forming a complete annular body case mounting structure 14 having a radially inwardly facing annular projection 18 (FIGS. 1 and 2).

Figure 8:
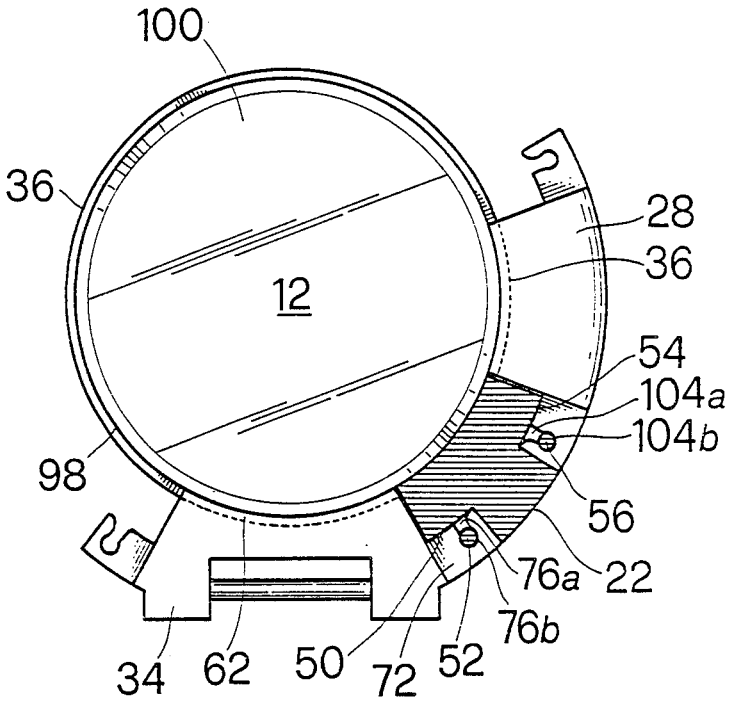
FIG. 8 is a plan view of the three segments shown in FIGS. 3–5 being interconnected to one another and mounted to the case body, with the intermediate segment being cut away to show the interlocking mechanism employed in the present invention.

FIG. 8 shows a plan view of three interconnecting segments 22, 28 and 34 being coupled to the main case body 12, with segment 22 being cut away to show the interconnecting mechanism.

It can be seen in FIG. 8 that segment 22 with female structures is disposed in an end-to-end relationship with segments 28 and 34 to form a series of segments defining a section of the case body mounting structure 14.

Segment 34 is coupled to segment 22 by means of the male and female structures of the respective segments. It is best shown in FIG. 8 that cylindrical pin 52 has a diameter receivable in a corresponding bore 76*b*. Pin 52 is first forced past access slot 76*a* with resilient deformation of the arm portion 72*a* and is then received and frictionally gripped by bore 76*b*. This snap-fitting action is achieved when projection 72 of segment 34 is press-fitted into the recess portion 50 of segment 22.

Similarly, pin 56 is snap-fitted to corresponding groove 104 of segment 28. Pin 56 is forced through slot access 104*a* and secured in bore 104*b*.

It is a characteristic of the present invention in that the segments 20, 22, 24, 26, 28, 30, 32 and 34 are mountable and dismountable in the radial direction relative to the main case body 12 and that the segments may be replaceable or interchangeable individually or in a series, if desired. Dismounted segment or series of segments may be replaced by a segment or series of segments of different colour and/or ornamental appearance. For example, segment 28 or 34 may be dismounted from the main case body 12 independently and replaced by another segment, or segments 28, 22 and 34 may be replaced by a one-piece segment. This results in a change of the appearance of the wrist watch in a relatively easy manner which is not readily available for conventional wrist watches.

Although it has been shown and described that the case body mounting structure 14 is composed of eight segments, it is understood that the number of segment may vary. Furthermore, the interconnecting structures of the segments are disclosed as having male structures disposed on segments 28, 30, 32 and 34 and female structures on segments 20, 22, 24 and 26, it can be realized that such disposition may appear in the opposite way, i.e. male structures being disposed on segments 20, 22, 24 and 26 and female structures on segments 28, 30, 32 and 34.

Figure 9:
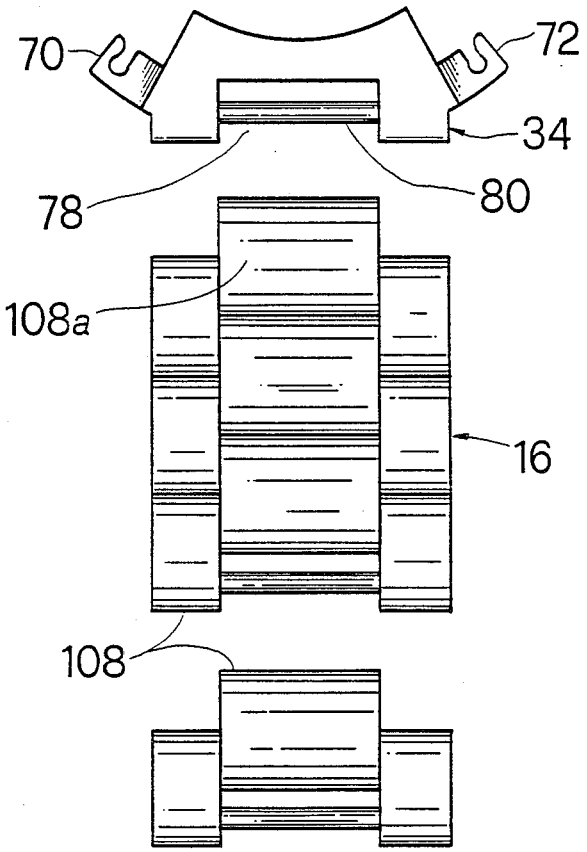
FIG. 9 is an exploded view of the strap mounting segment and a portion of the strap.

FIG. 9 is an exploded view of the strap receiving segment 34 and part of strap 16 to be attached thereto. Watch strap 16 are mainly composed of links 108. Each link 108 is, according to the illustrated embodiment, provided with a transversely extending groove at one end thereof and an elongated bar member at the other end thereof. The groove of a first link is adapted to receive and frictionally grip the bar member of a second adjacent link. This bar member of the second link defines an axle upon which the first link may pivot.

Although it is illustrated that end link 108*a* is adapted to be receivable in the cutout portion 78 of segment 34, it is contemplated that each link 108 is adapted to removably engage to one another and to the strap receiving segments 32 or 34.

FIGS. 10–15 depict a buckle means defining a fastening means of the strap 16 according to the present invention. The fastening means is composed of a first member 118 which is releasably attached to one free end of the strap 16 and a second member 120 which is releasably attached to the other free end of the strap 16.

Figure 10:
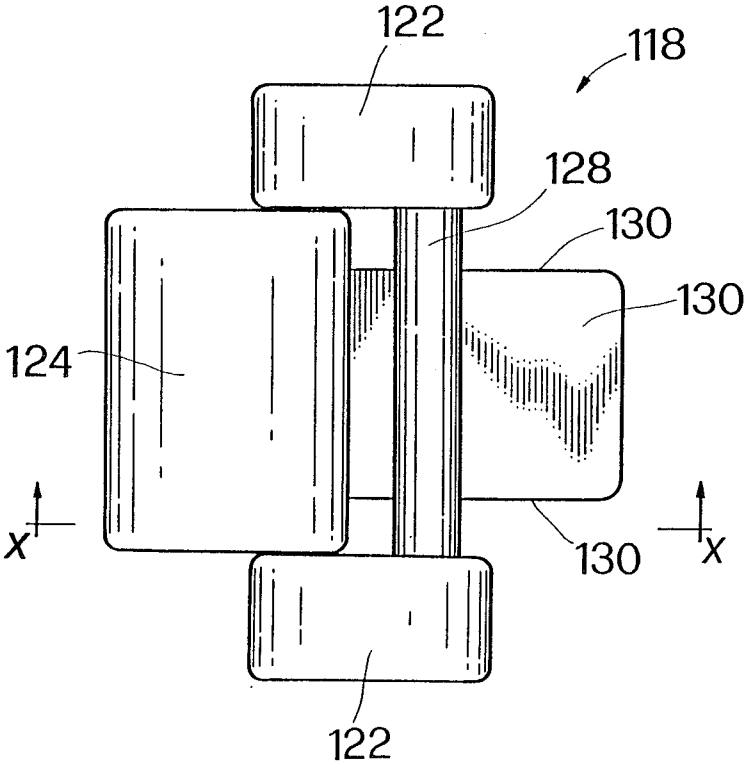
FIG. 10 is an enlarged plan view of a first attachment means for the strap according to the present invention.
Figure 11:
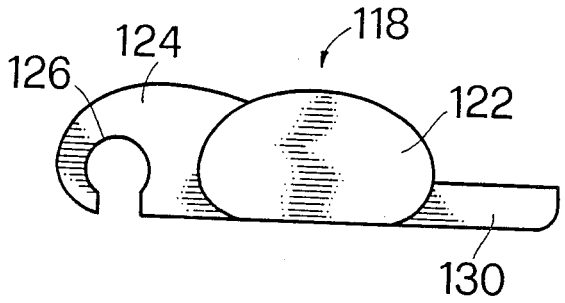
FIG. 11 is a side view of the first attachment means in FIG. 10.
Figure 12:
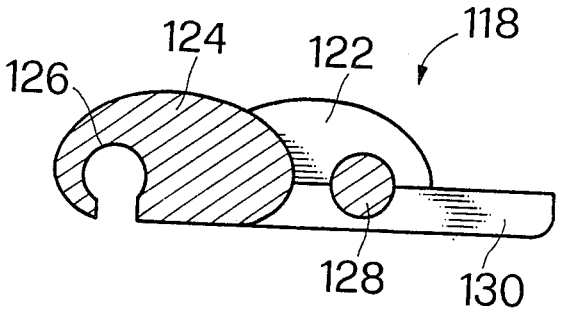
FIG. 12 is a sectional view of the first attachment means taken generally along line X—X of FIG. 10.

As shown in FIGS. 10, 11 and 12, first member 118 consists of, according to the preferred embodiment, two outer link bodies 122, 122 and a center link body 124. The two outer link bodies 122, 122 are spaced transversely apart with respect to the longitudinal direction of the strap 16. The center link body 124 is generally disposed intermediate the two spaced outer link bodies 122, 122 and is partially attached thereto at one end portion thereof, as best illustrated in FIG. 10.

A transversely extending and downwardly facing groove 126 is provided on the bottom surface of the center link body 124 at one end portion thereof for receiving a bar member of an adjacent link 108. Provided intermediately of the two spaced outer link bodies 122, 122 is a transversely extending bar member 128 having a diameter substantially equal to that of the bar member of link 108 and being receivable in a corresponding groove of the second member 120. The bar member 128 is being spaced longitudinally apart from the center link body 124 thereby providing a space for receiving a counterpart of the second member 120.

Reference numeral 130 denotes a tongue portion generally having a rectangular plan view. Tongue portion 130 extends longitudinally outwardly from an end portion of the center link body 124 and having the lateral sides 130*a*, 130*a* thereof being disposed at a distance inwardly of the inner surfaces of the outer link bodies 122, 122.

The longitudinally extending tongue portion 130 is crossed and joined integrally with the transversely extending bar member 128 at a substantial length thereof so that the longitudinal axis of the bar member 128 lies on the plane defined by the upper surface of the tongue portion 130.

Figure 13:
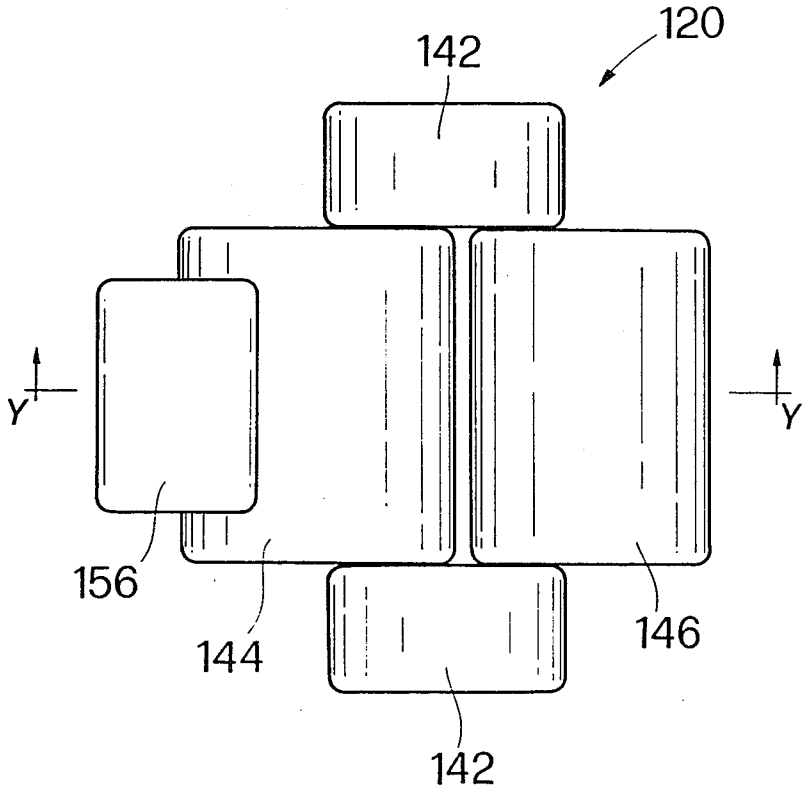
FIG. 13 is an enlarged plan view of a second attachment means for the strap.
Figure 14:
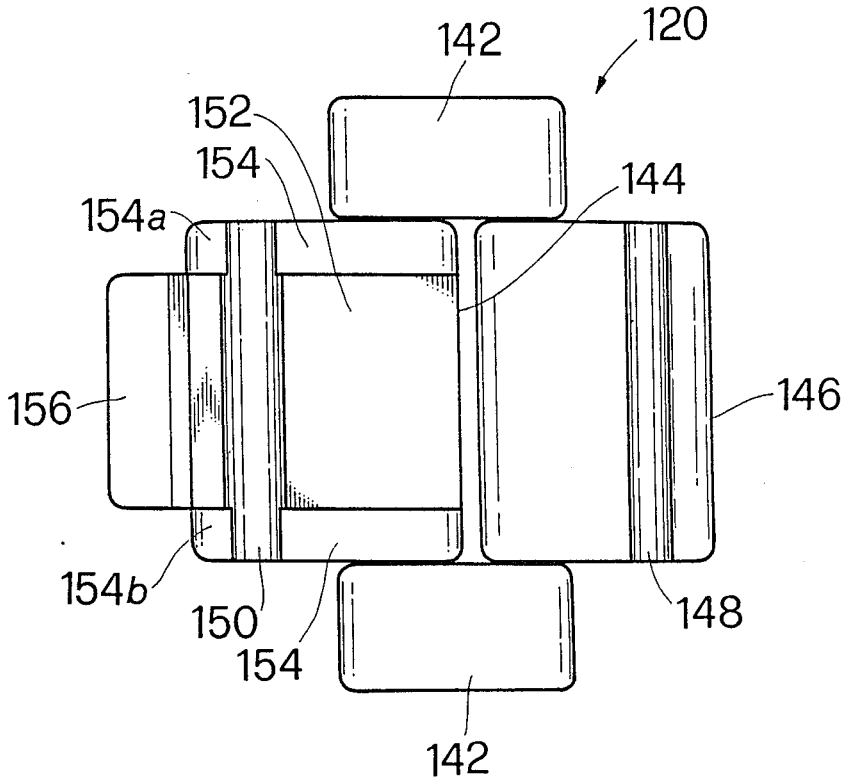
FIG. 14 is an underneath plan view thereof.
Figure 15:
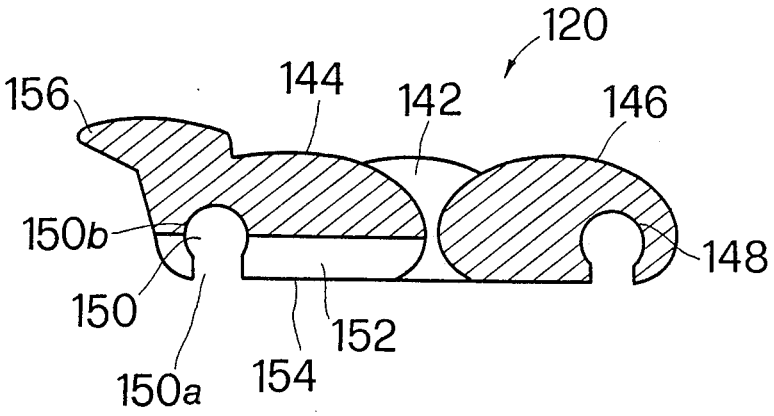
FIG. 15 is a sectional view of the second attachment means taken generally along line Y—Y of FIG. 13.

As shown in FIGS. 13, 14 and 15, a second member 120 consists of, according to the preferred embodiment, two outer link bodies 142, 142, a first center link body 144 and a second center link body 146. The outer link bodies 142, 142 are spaced transversely apart with respect to the longitudinal direction of the strap 16. The center link bodies 144 and 146 are generally disposed intermediate the two spaced outer link bodies 142, 142 and are partially affixed thereto at respective end portion thereof.

A transversely extending and downwardly facing groove 148 is provided on the bottom surface of the center link body 146 for receiving a bar member of an adjacent link 108. A second transversely extending and downwardly facing groove 150 is provided on the bottom surface of the center link body 144 for receiving the bar member 128 of the first member 118.

A longitudinally extending recess 152 is disposed on the bottom surface of the center link body 144 and is defined by the lower surface of the center link body 144 and the two longitudinally extending pendants 154, 154 provided integrally on and depending downwardly from the opposite longitudinal sides of the center link body 144.

Lug 156 protruding generally upwardly and outwardly from the center link body 144 and overhanging the center link body 124 of the first member 118 when the first member is in engagement with the second member 120.

The first member 118 is releasably engaged with the second member 120 in a press-fit as bar member 128 is forced past access slot 150*a* and received and secured in bore 150*b*. When the first member 118 and the second member 120 are in an engaged position, tongue portion 130 is fitted into the recess 152. To disengage the first member 118 from the second member 120, it is sufficient to introduce the tip of a finger nail into the space between the lug 156 and the center link body 124 of the first member 118 and lift the second member 120 by the lug 156 in an outward direction relative to the upper surface of the strap 16. This renders disengagement of the fastening means by a relatively simple gesture.

Although it has been disclosed in the preferred embodiment that segments 20, 22, 24, 26, 28, 30, 32 and 34 are engaged to one another by means of coupling means provided on the segments, it is appreciated that the segments may be provided with means for releasable engagement with the main case body 12 at the outer peripheral portion thereof.

While the present invention has been shown and described with particular reference to a preferred embodiment thereof, it should be noted that various other changes or modifications may be made without departing from the scope of the present invention.

I claim:

1. A composite wrist watch comprising a case body, a case body mounting structure for securing said case body therein and a strap removably mounted to said case body mounting structure, said case body mounting structure comprising a plurality of at least three segments each being disposed radially from the outer circumferential portion of said case body and having means provided thereon for releasable engagement with adjacent segments, said plurality of segments being arranged in radial alignment and having at least a part of the surfaces defining a portion of the exterior configuration of said wrist watch, wherein said segments are adapted to be mountable and dismountable in the radial direction with respect to said case body, said strap comprising a plurality of links each having coupling means provided thereon adapted to removably couple to one another or to a strap receiving segment of said case body mounting structure by means of snap-fit action.

2. A composite wrist watch as claimed in claim 1, wherein said case body mounting structure comprising at least one first segment and at least one second segment being disposed alternately with said first segment, each said first segment being moulded in one piece of plastic material and having an arcuate wall defining a surface against which part of the outer circumferential surface of said case body is abutted, two end walls being spaced apart by said first arcuate wall and disposed at an angle to each other, a front end wall defining part of the exterior configuration of said wrist watch, and a radially extending recess disposed substantially at a peripheral portion intermediate each said end wall and said front end wall defining a female structure having an engagement means provided therein, each said second segment being moulded in one piece of plastic material and having an arcuate wall defining a surface against which the other part of the outer circumferential surface of said case body is abutted, two end walls being spaced apart by said arcuate wall of said second segment and disposed at an angle to each other, a front end wall defining part of the exterior configuration of said wrist watch, and a projection projecting outwardly from each said end wall of said second segments and defining a male structure adapted to be receivable in a corresponding recess of an adjacent first segment, said projection has an inwardly facing and vertically extending groove provided thereon for receiving and frictionally gripping a corresponding engagement means therein.

3. A composite wrist watch as claimed in claim 1 or claim 2, wherein each segment comprises a radially inwardly directed projection projecting from the upper portion of said arcuate wall and defining part of a radially inwardly facing annular projection to engage a corresponding recess provided at the upper peripheral portion of said case body, and wherein at least one of said segments further comprising an inwardly directed stop means extending from a lower portion of said arcuate wall to engage a recess provided at a lower peripheral portion of said case body, whereby axial movement of said case body relative to said case body mounting structure is prevented.

4. A composite wrist watch as claimed in claim 2, wherein said groove comprises an access slot and a part cylindrical portion defining a through socket for receiving and frictionally gripping a corresponding engagement means therein.

5. A composite wrist watch as claimed in claim 2, wherein said engagement means is a cylindrical pin extending vertically along and substantially at the center of said recess and having a diameter receivable in a corresponding through socket of a projection.

6. A composite wrist watch as claimed in claim 1 or claim 2, wherein said case body mounting structure consists of two strap receiving segments each having means provided thereon to removably couple to respective ends of the strap.

7. A composite wrist watch as claimed in claim 1 or claim 2, wherein at least one of said segments is provided with a radially extending cutout portion for receiving a winding stem sheath integrally extending from an outer circumferential portion of said case body and passing therethrough.

8. A composite wrist watch as claimed in claim 1, wherein said strap further comprises a fastening means having a first member and a second member, said first member being moulded in one piece of plastic material comprising a center link body, two outer link bodies being spaced apart transversely with respect to the longitudinal direction of said strap by said center link body and attached thereto at a first end portion thereof, a transversely extending and downwardly facing groove being provided on the undersurface of said center link body at a second end portion thereof for receiving a corresponding bar member of an adjacent link, a transversely extending bar member being disposed intermediate said outer link bodies, and a longitudinally extending tongue portion projecting outwardly from said first end portion of said center link body and having its lateral sides thereof being spaced apart from respective inner surface of said outer link bodies, said tongue portion being crossed and joined integrally with said bar member of the first member so that the longitudinal axis of said bar member lies on the plane defined by the upper surface of said tongue, said second member being moulded in one piece of plastic material comprising a center link body, two outer link bodies, said outer link bodies being spaced apart transversely with respect to the longitudinal direction of said strap by said center link body and affixed thereto, a first transversely extending and downwardly facing groove being provided on the undersurface of said center link body at a first end portion thereof for receiving said bar member of said first member, a second transversely extending and downwardly facing groove being disposed on the undersurface of said center link body at a second end portion thereof for receiving therein a corresponding bar member of an adjacent link, a longitudinally extending recess being disposed on the undersurface of said center link body for receiving said tongue portion therein, and a lug protruding generally upwardly and outwardly from the first end portion of said center link body and overhanging the first end portion of the center link body of said first member when said first member is in engagement with said second member, whereby disengagement of said second member from said first member is achieved by lifting said second member away from said first member by said lug.

* * * * *

UNITED STATES PATENT AND TRADEMARK OFFICE

CERTIFICATE OF CORRECTION

PATENT NO. : 4,757,485

DATED : July 12, 1988

INVENTOR(S) : Po Man TAM

It is certified that error appears in the above-identified patent and that said Letters Patent are hereby corrected as shown below:

On the title page:

Inventor : "Tam P. Man" should be -- Po Man TAM --

Title page: Item [19], "Man" should read --Tam--.

Col. 1 line 7, "inteconnected" should be -- interconnected --

Col. 1 line 31, after the word, body, "are" should be -- and --

Signed and Sealed this

Twenty-fourth Day of January, 1989

*Attest:*

DONALD J. QUIGG

*Attesting Officer*

*Commissioner of Patents and Trademarks*